United States Patent [19]

Henderson et al.

[11] 3,974,816

[45] Aug. 17, 1976

[54] ELECTRONIC IGNITION SYSTEM WITH COMBINED OUTPUT FROM MULTIPLE COILS

[75] Inventors: Robert M. Henderson, Williams Bay; Richard Zechlin, Beloit, both of Wis.; K. Narasimha Reddy, Highland, Ill.

[73] Assignee: Colt Industries Operating Corporation, New York, N.Y.

[22] Filed: July 17, 1974

[21] Appl. No.: 489,410

[52] U.S. Cl. ..... 123/148 CC; 123/149 R

[51] Int. Cl.[2] ..... F02P 1/00

[58] Field of Search ..... 123/148 E, 148 MC, 149 R, 123/149 C

[56] References Cited

UNITED STATES PATENTS

| | | | |
|---|---|---|---|
| 3,356,896 | 12/1967 | Shanto | 123/148 MC |
| 3,461,851 | 8/1969 | Stephens | 123/148 E |
| 3,464,397 | 9/1969 | Burson | 123/148 MC |
| 3,630,185 | 12/1971 | Struber | 123/148 MC |
| 3,678,913 | 7/1972 | Zimmerman et al. | 123/148 MC |
| 3,741,185 | 6/1973 | Swift | 123/149 R |
| 3,809,962 | 5/1974 | Brown et al. | 317/33 SC |
| 3,842,816 | 10/1974 | Vargas | 123/148 E |
| 3,886,916 | 6/1975 | Henderson | 123/117 R |
| 3,893,439 | 7/1975 | Chudoba | 123/148 E |
| R27,704 | 7/1973 | Carmichael et al. | 123/148 MC |

*Primary Examiner*—Charles J. Myhre
*Assistant Examiner*—Paul Devinsky
*Attorney, Agent, or Firm*—Leo J. Aubel

[57] ABSTRACT

An electronic ignition control system including one coil assembly having a high number of turns to charge the associated capacitors to a desired level when the speed of the engine is low, and another coil assembly having a low number of turns to charge the capacitors to a desired level when the speed of the engine is high to thereby provide energy at a suitable level to fire the associated spark plugs. The system also includes means for regulating the voltage supplied by the alternator coils to a battery and thus preventing the battery from overcharging; and, means are provided for driving a tachometer proportionally to the firing pulses supplied to the spark plugs.

1 Claim, 1 Drawing Figure

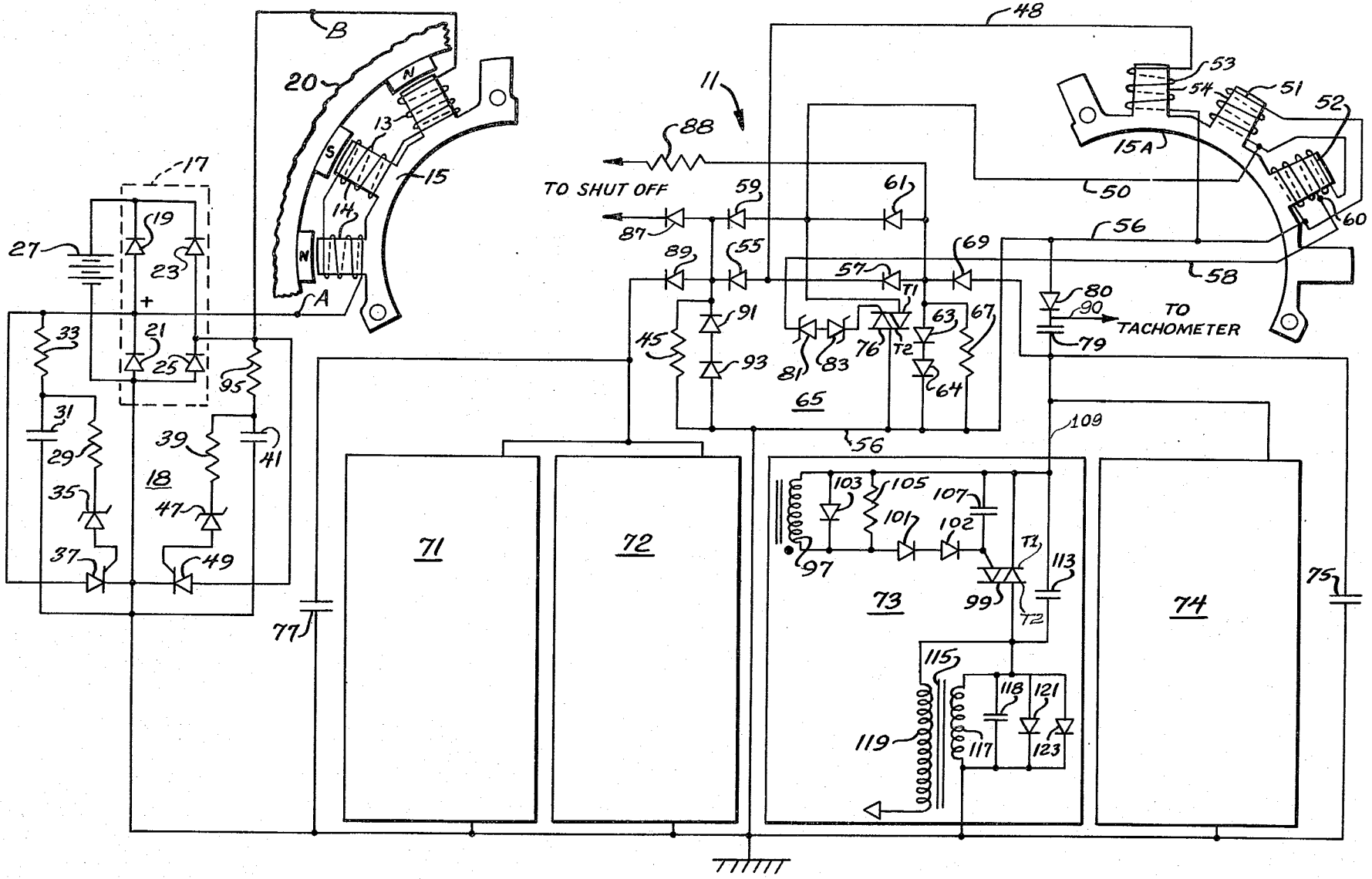
TO TACHOMETER
TO SHUT OFF
71
72
73
74
65
11
13
14
15
15A
17
18
20
27
48
50
51
52
53
54
55
56
57
58
59
60
61
63
64
67
69
75
76
77
79
80
81
83
87
88
89
90
91
93
95
97
99
101
102
103
105
107
109
113
115
117
118
119
121
123
19
21
23
25
29
31
33
35
37
39
41
45
47
49
A
B
T1
T2
N
S

ELECTRONIC IGNITION SYSTEM WITH COMBINED OUTPUT FROM MULTIPLE COILS

BACKGROUND OF THE INVENTION

This invention and application are generally related to U.S. Patent application, Ser. No. 389,680, filed in the name of Robert M. Henderson and assigned to the same assignee as the present invention.

Electronic ignition control systems of various kinds are well known in the art. Certain prior art systems utilize rotating mechanical distributors in combination with breaker and breaker points to synchronize fuel ignition with engine operation. More recently, with the development of solid state semi-conductor components, solid state electronic ignition circuits have been utilized to replace mechanical distributors and breaker systems. These circuits frequently utilize the rectified output from an A.C. generator to charge a capacitor which is then discharged through a solid state switching circuitry into the primary winding of an associated ignition coil.

Commonly, in standard prior art systems, one capacitor source is utilized for all ignition transformers and either one or a number of switching devices are used to selectively couple the stored energy from the capacitor to the ignition transformer. Accordingly, if the capacitor or one of the switching devices electrically shorts, the entire system fails.

An object of this invention is to provide an improved, more effective electronic control system. And, more specifically, a system including a power coil assembly having a relatively high number of turns such that the coil assembly is effective to maintain the current which is available to charge the associated storage capacitors sufficiently high when the engine is rotating at a low rate of speed, and another coil assembly having a relatively low number of turns such that these latter coils are effective to charge the capacitors to a selected level when the engine is rotating at a high speed.

An advantage of the present system is that separate capacitors are utilized and each capacitor is isolated from the other capacitor in its charging and discharging action and switching devices are connected separately to each capacitor. Thus, if one capacitor or one of the switching devices shorts, those cylinders associated with the shorted capacitor or switching device will cease functioning; however, the engine will continue to operate on those cylinders not associated with the shorted capacitor or switching device.

The subject invention also includes an improved triggering circuit for providing trigger pulses to energize the associated spark plugs.

The subject invention also provides a system wherein the voltage supplied by the alternator to the battery is controlled to maintain the voltage at a desired level to prevent the battery from overcharging.

Another feature of the invention is the provision of a modularized trigger assembly which can be readily adapted to operate with one or more cylinders.

The foregoing and other objects, features and advantages of the invention will be apparent from the following more particular description of a preferred embodiment of the invention, as illustrated in the accompanying drawing wherein:

DESCRIPTION OF THE DRAWING

The sole FIGURE shows a circuit diagram of the control system of the invention.

DESCRIPTION OF THE INVENTION

Referring to the FIGURE, the electronic ignition control system 11 of the invention includes a first coil assembly generally labeled 13 comprising series connected coils which are mounted on spaced, radially extending pole pieces, generally labeled 14 on stator 15. Another portion of the system 11 includes a stator 15A on which a coil assembly comprising coils 51, 52 and 53 is mounted on spaced radially extending pole pieces, generally labeled 54.

The pole pieces 14 and 54 are influenced by rotating permanent magnets mounted on flywheel 20 (only a part of the flywheel being shown in the FIGURE). In accordance with known principles of permanent magnet generators, an AC voltage is induced in the coils 51, 52 and 53 when the magnets on flywheel 20 move relative to the pole pieces 14 and 54.

The coil assembly comprising coils 51, 52 and 53 is utilized to generate energy for the ignition coils of the engine and coil assembly 13 is utilized for generating the energy to charge the associated battery. Thus, the same permanent magnet system is utilized to generate both the energy for the ignition circuit and the energy for charging the associated battery. However, the ignition circuit and the battery charging circuit are electrically independent and are arranged such that failure in one set of coils does not cause a malfunction of the other coils.

Coils 51 and 52, comprise coil windings having a relatively high number of turns, and coil 53 comprises a coil winding comprising a relatively low number of turns. Coils 51, 52 and 53 are connected to a capacitor charging circuit 65, now to be described. More specifically, one terminal of coil 53 is connected through lead 48 to the junction of series connected diodes 55 and 57 and the other terminal of coil 53 is connected through lead 56 to ground reference. Coil 51 has its lower terminal, and coil 52 has its upper terminal connected through lead 50 to the junction of series connected diodes 59 and 61, and to the main terminal T1 of a triac 76. The upper terminal of coil 51 and the lower terminal of coil 52 are connected through lead 56 to ground reference.

An intermediate tap 60 on coil 52 is connected through lead 58, and back-to-back series connected zener diodes 81, 83 to the gate electrode of triac 76. The main terminal T2 of triac 76 is connected to ground.

The anodes of diodes 57 and 61 are connected in common and through series connected diodes 63 and 64 to lead 56 and ground reference. A resistor 67 is connected in parallel with diodes 63 and 64. The anodes of diodes 57 and 61 are also connected to the cathode of diode 69 and thence to the triggering circuits 73 and 74 of the associated engine cylinders, and to storage capacitor 75 which is connected in parallel to the triggering circuits 73 and 74.

The junction of diode 69 and capacitor 75 is connected to series connected capacitor 79 and diode 80 to ground lead 56. In turn, the junction of capacitor 79 and diode 80 is connected to a tachometer generator, of conventional design, not shown. Trigger circuits 73 and 74 in conjunction with capacitor 75 develop a signal across diode 80 through capacitor 79 which drives the tachometer, as will be explained hereinbelow.

The cathodes of diodes 55 and 59 are connected in common and to the anode of diode 89 and thence to ignition circuits 71 and 72 of the associated cylinders, and to storage capacitor 77 which is connected in parallel with ignition circuits 71 and 72.

A pair of diodes 91 and 93 connect the junction of diodes 55 and 59 to ground reference, and a resistor 95 is connected in parallel to diodes 91 and 93.

The common junction of diodes 55 and 59 and the common junction of diodes 57 and 61 are connected through diode 87 and resistor 88 respectively to a shut-off circuit as indicated.

The operation of the capacitor charging circuit 65 will now be described. Voltages of alternating polarity are generated in coils 51, 52 and 53 upon rotation of the flywheel 20, in accordance with well known principles of permanent magnetic generators. The frequency of the voltages generated by coils 51, 52 and 53 is proportional to the speed of the flywheel 20.

A feature of the invention is that the negative portion of the alternating voltage generated by coils 51, 52 and 53 charges capacitor 75 and the positive portion of the alternating voltage charges capacitor 77. The fact that capacitors 75 and 77 are charged to relatively opposite polarities permits fewer components to be utilized in the system.

Assume a voltage VC, which is the voltage to which it is desired capacitors 75 and 77 be charged. Zener diodes 81 and 83 are selected such that if the voltage developed across coils 51 and 52 tends to exceed voltage VC, Zener diodes 81 and 83 will conduct current thereby turning on triac 76 and effectively shorting coils 51 and 52. Accordingly, capacitors 75 and 77 cannnot be charged to a voltage level exceeding voltage VC.

The maximum current developed by the coils 51, 52 and 53 to charge the capacitors 75 and 77 is inversely proportional to the number of turns on the coils and relatively independent of engine speed, while the voltage available to charge capacitors 75 and 77 is directly proportional to the number of turns and engine speed. If, for example, three coils having a relatively high number of turns are used, the current available to charge capacitors 75 and 77 is not sufficiently high to maintain the desired voltage across the capacitors at high speeds. Therefore, the high turn coils 51 and 52 are provided which are effective to charge capacitors 75 and 77 at low engine speeds while a low turn coil 53 is provided which is effective to charge capacitors 75 and 77 at high engine speeds. The high turn coils 51 and 52 provide a fast rise in output voltage. For example, the open circuit output voltage from the high turn coils rises from 0 to, say 3000 volts as the speed of operation increases from 0 to 3000 RPM. The voltage to which capacitors 75 and 77 are charged by action of high turn coils tends to increase to a maximum as the speed of operation increases to, say 1000 RPM and then decreases at a relatively fast rate. Zener diodes 81, 83 and triac 76 are provided to limit or clip the output voltage at a selected level, say 300 volts.

The output of the low turn coil 53 increases almost linearly from zero RPM toward a maximum voltage at maximum speed operation. And, coil 53 is selected such that the maximum output voltage developed within the speed operating range is less than the selected desired level, hence the output of coil 53 need not be clipped or limited which feature reduces the number of components required in the circuit.

The output from the high turn coils 51 and 52 is effectively combined with the output from the low turn coil 53, such that the combined voltage output from the coils rises to the selected level relatively quickly, and is maintained at that level throughout the operating range. Thus, the circuit of the invention is effective to provide a suitable energizing spark to the associated spark plugs throughout the operating range of the engine. The use of high turn coils only could not provide the same advantages as provided by above described combination of the high turn coils and the low turn coils.

The protective triac 76 and the associated circuit are connected in parallel with the coils and short out the coils when the voltage generated by the coils tends to exceed the zener diode limit.

The number of turns on coil 53 are chosen so that in the operating range of the engine, the circuit peak voltage will be less than voltage VC. Thus, coil 53 cannot charge capacitors 75 and 77 above the voltage level VC even though it does not have a high voltage protection circuit connected thereto.

Note that while the embodiment shown utilizes two high turn coils and one low turn coil, the invention is not limited to the number shown.

The circuit possesses another advantage in that if the high turn coils fail, the low turn coil operates reliably, and vice versa.

As mentioned above, a signal proportional to the speed of the engine rotor is coupled through lead 90 to the tachometer. To explain, when capacitor 75 is charged, capacitor 79 is also charged through diode 80. When trigger circuits 73 or 74 turn on, the voltage across capacitor 75 goes to zero and capacitor 79 discharges through tachometer generator circuit. The energy in capacitor 79 is used to drive the tachometer generator. Thus, for every firing pulse of circuit 73 or 74, energy is sent to the tachometer generator, and accordingly, the number of pulses is proportional to speed.

The triggering portion of the electronic control circuit 11 is included in blocks 71, 72 73 and 74. The circuitry in each of the blocks is essentially identical, and one block is associated with a respective cylinder; and, while four blocks are shown, the invention is equally applicable to engines having more or less cylinders.

Since the circuitry of each of the blocks is similar and their operation is similar, only the circuit in block 73 is shown and described in detail. Referring to the circuit of block 73, a trigger coil 97 is energized by a pulse energy from associated rotor, as explained fully in the above mentioned patent application of R.M. Henderson, Ser. No. 389,680, to thereby provide a triggering pulse to turn ON an associated triac 99. One terminal of trigger coil 97 is connected through noise suppressing diodes 101 and 102 to the gate electrode of triac 99, and the other terminal of coil 97 is connected to the main terminal T1 of triac 99. Note that a silicon controlled rectifier (SCR) may be used in lieu of triac 99. A diode 103 and a resistor 105 are connected in parallel with coil 97 to short out voltages developed across coil 97 which have a relatively negative polarity. A noise filtering capacitor 107 is connected across the main terminal T1 to gate electrode of triac 99, and a noise suppressing capacitor 113 is connected across the main terminals T1 and T2 of the triac 99.

The main terminal T1 of triac 99 is connected through lead 109 to the junction of the storage capacitor 75 and diode 69. The main terminal T2 of triac 99 is connected to one terminal of the primary winding 117 of an autotransformer 115. The other terminal of winding 117 is connected to ground reference. A capacitor 118 and diodes 121 and 123 are connected in parallel across winding 117 as noise filters and spike suppressors. The diodes 121 and 123 function essentially as energy absorbing elements and permit the associated triac 99 to run at a much higher current level, or alternatively, permit a relatively smaller rated triac 99 to be utilized.

One terminal of the secondary high voltage winding 119 is connected to winding 117 of transformer 115 and the other terminal of winding 119 is connected to an associated spark plug indicated by the arrowed terminal.

In operation, the trigger coil is energized in response to the associated rotor as described in the aforesaid application of R.M. Henderson, Ser. No. 389,680, to generate the trigger pulses.

Assume at this point, that capacitor 75 is charged to a selected potential. When the pulse on the lower terminal of the winding 97 is positive, the pulse is coupled through diodes 101 and 102 to the gate electrode of triac 99. Triac 99 is rendered conductive thereby providing a discharge path for capacitor 75 through autotransformer 115 to ground. When capacitor 75 discharges, a high voltage pulse is developed in auto-transformer 115 to cause the associated spark plug to fire.

As mentioned above, if diodes 63, 64 or capacitor 75, or the triac in triggering circuit 74 corresponding to triac 99 are electrically shorted for some reason, the other triggering circuits 71 and 72 and the capacitor 77 will continue to operate normally, thus allowing the engine to be operated to allow the associated vehicle to be taken to a point of repair. Similarly, if diodes 91, 93 or capacitor 77, or the triacs in trigger circuits 71 and 72 corresponding to triac 99 are electrically shorted, trigger circuits 73 and 74 and the capacitor 75 will operate normally. The foregoing is obviously a very desirable feature.

Triggering circuit 73 has been found to provide a sharp, discrete and accurately timeable pulse to control the ignition of the associated spark plug.

The inventive system further includes circuitry wherein the voltage supplied by the alternator to a battery is controlled to maintain the voltage at a desired level to prevent the battery from overcharging.

The series connected coils 13 have one terminal labeled A connected to the junction of diodes 19 and 21 of a single phase conventional diode bridge rectifier 17 comprising diodes 19, 21, 23 and 25. The other terminal of coil 13, labeled B, is connected to the junction of diodes 23 and 25. A battery 27, connected across the bridge rectifier 17, is charged through rectifier 17 by the power generated in the alternator coil 13. The junction of diodes 19 and 21 is also connected to the anode of a silicon controlled rectifier (SCR 37), and the junction of diodes 23 and 25 is connected to the anode of an SCR 49. The cathodes of SCR's 37 and 49 are connected to ground reference. The gate electrode of SCR 37 is connected through a series circuit consisting of zener diode 35 and resistors 29 and 33 to the junction of diodes 19 and 21. A capacitor 31 is connected from the junction of resistors 33 and 29 to ground reference.

Similarly, the gate electrode of SCR 49 is connected through the series circuit of zener diode 47 and the resistors 39 and 45 to the junction of diodes 23 and 25. A capacitor 41 is connected from the junction of resistors 39 and 45 to ground reference.

Capacitors 31 and 41 absorb any spurious spikes which occur due to spark noise or other interferences; and, prevent SCR's 37 and 39 from being turned ON due to noise or other unwanted interference.

As mentioned, the battery 27 is charged through rectifier 17 by the A.C. voltage developed by the coils 13. Zener diodes 35 and 47 in conjunction with associated resistors 29, 33 and 39, 45 respectively, are selected such that SCR 37 and SCR 49 are turned ON at a desired voltage VB.

For purposes of explanation, assume that a voltage VK is related as follows:

$$VK = VB + V19 + V25$$

Where

*VB* is the desired voltage to which the battery is to be charged.

*V*19 is the voltage drop across diode 19.

*V*25 is the voltage drop across diode 25; and,

*VK* is the summed voltage having the relation indicated by the formula.

If the voltage at terminal point A tends to rise above the level of VK, the breakdown voltage of zener diode 35 is exceeded causing current to flow through resistors 29 and 33, and zener diode 35, and the gate to cathode electrodes of SCR 37 thereby causing SCR 37 to conduct. When SCR 37 conducts, the battery 27 is, in effect, by-passed by the charging current and the battery cannot be charged over the voltage level VB.

A similar result is obtained if the voltage at terminal point B rises above the level of voltage VK; the operation is similar to the above.

The assumed voltage VK is also related by the formula:

$$VK = VB + V21 + V23$$

Where

*V*21 is the voltage drop across diode V21 and

V23 is the voltage drop across diode 23.

Thus, if the voltage at terminal point B tends to rise above the level of voltage VK, the zener diode 47 will breakdown and cause the current to flow to turn SCR 49 ON.

Accordingly, battery charging circuit 18 prevents the battery 27 from over-charging, and maintains the battery voltage at a desired voltage level. Such result is obtained even if battery 27 is disconnected. No voltage higher than VK can appear across either of the input terminals of the bridge rectifier 17, since, as the voltage level tends to go above VK, either SCR 37 or SCR 49 will conduct and thus by-pass battery 27.

While the invention has been particularly shown and described with reference to a preferred embodiment thereof, it will be understood by those skilled in the art that various changes in form and details may be made therein without departing from the spirit and scope of the invention.

What is claimed is:

1. An electronic control system for a spark ignition engine including means for energizing a plurality of electronic triggering circuits in timed spaced intervals, comprising first and second coil means, magnetic means interacting with said coils for generating an AC voltage, said first coil means having a relatively high number of turns and said second coil means having a relatively low number of turns, at least first and second storage capacitor means, the output from said first coil means being connected to said first and second storage capacitor means and being primarily effective to charge said first and second storage capacitor means when said engine is operating at a relatively low rate of speed, and the output from said second coil means being connected to said capacitor means and being primarily effective to charge said capacitor means when said engine is operating at a relatively high rate of speed, circuit means for combining the output from said first and second coil means for charging said first and second storage capacitor means to a selected level throughout essentially the entire operating range of the engine, and means connecting the output of said coil means to charge one of the storage capacitor means to one polarity and the other of the storage capacitor means to the other opposite polarity, said first and second storage capacitor means being isolated from each other and having isolated charging and discharging action and separate switching means.

* * * * *